US006175295B1

(12) United States Patent
Honma

(10) Patent No.: US 6,175,295 B1
(45) Date of Patent: Jan. 16, 2001

(54) INDUCTANCE DEVICE

(75) Inventor: Tooru Honma, Tokyo (JP)

(73) Assignee: TDK Corporation, Tokyo (JP)

( * ) Notice: Under 35 U.S.C. 154(b), the term of this patent shall be extended for 0 days.

(21) Appl. No.: 09/368,567

(22) Filed: Aug. 5, 1999

(51) Int. Cl.[7] ..... H01F 27/36
(52) U.S. Cl. ..... 336/84 R; 336/192; 336/198
(58) Field of Search ..... 336/73, 178, 192, 336/198, 165, 208, 84 R

(56) References Cited

U.S. PATENT DOCUMENTS 4,900,879 * 2/1990 Buck et al. ..... 174/120 R
5,898,354 * 4/1999 Lee ..... 336/96
6,002,319 * 12/1999 Honma ..... 336/73

FOREIGN PATENT DOCUMENTS 0 825 623 2/1998 (EP) .
0 901 136 3/1999 (EP) .
2518241 9/1996 (JP) .
2518250 9/1996 (JP) .

* cited by examiner

*Primary Examiner*—Michael L. Gellner
*Assistant Examiner*—Tuyen Nguyen
(74) *Attorney, Agent, or Firm*—Oblon, Spivak, McClelland, Maier & Neustadt, P.C.

(57) ABSTRACT

In an inductance device in which a coil is wound around a bobbin having at least two chambers divided by a collar and a ferrite core is mounted, the bobbin includes a chamber having a center hole for inserting a center leg of the core and two outer holes for each inserting an outer leg of the ferrite core in a bottom portion of the bobbin, a shield coil having a portion which is wound in a direction perpendicular to the primary coil via the collar portions of the bobbin, both ends of the shield coil being connected to a terminal, the shield coil is formed by a triple-layered insulated wire.

2 Claims, 8 Drawing Sheets

INDUCTANCE DEVICE

BACKGROUND OF THE INVENTION

1. Field of the Invention

The present invention relates to a transformer and an inductor which are used in a switching regulator, and more particularly to those using a split-type bobbin.

2. Discussion of the Background

It is conventionally known that, in various transformers and inductors for switching power supplies, leakage flux to the outside occurs during the operation of the transformer and the inductor. To shield this leakage flux, a method is generally taken in which a copper plate shield ring is provided on side surfaces of the transformer via outer peripheral portions of a core, as shown in FIG. 6. In addition, as shown in Japanese Utility Model Registration No. 2518250 and Japanese Utility Model Registration No. 2518241, methods are disclosed in which a shielding effect similar to that of the aforementioned copper plate shield ring is obtained by forming a shield coil making use of a wire without using the copper plate shield ring.

With the above-described conventional transformer and inductor, the following problems were encountered.

Although the manufacture of the transformers and inductors is generally automated, in the manufacturing method for providing the copper plate shield ring on the side surfaces of the transformer and the inductor as shown in FIG. 6, the fitting and soldering in a manual operation are still the mainstream, and the number of manufacturing steps is large, and the simplification of the process and automation are hampered.

Although a method has been proposed in which, in FIG. 7, instead of the copper plate shield ring a chamber is provided around a bobbin upper collar portion 70, and a shield coil 74 is formed by a wire. In this structure, a winding start and a winding end of the shield coil are connected to a terminal 71 embedded in the bobbin upper collar portion 70 so as to form a short-circuited ring. Accordingly, soldering processing of the terminal 71 is required, and in order to complete the transformer, two times of soldering processing including that for opposite-side bobbin terminals 79 is performed. Accordingly, the number of manufacturing steps increased, which is not desirable.

In FIG. 8, on the other hand, a shield coil 84 in the form of a short-circuited ring is formed by a wire, and after the core and the bobbin are combined, the shield coil 84 is fitted in two shield-coil receiving portions 81 formed in a bobbin upper collar portion 80. Hence, there is a problem in the stability of the shield coil 84, and the step of fabricating the shield coil is separately required, which is not desirable.

In the above-described structure of the shield coil using the wire, the direction of leakage flux which can be shielded is only the vertical direction of the transformer and the inductor, and an effect is not obtained with respect to the leakage flux on the overall side surfaces of the core outer legs.

SUMMARY OF THE INVENTION

In view of the above-described problems, an object of the present invention is to provide an inductance device which permits simplification or automation of the process of forming a shield coil using a wire and which is provided with a shielding effect.

Namely, in accordance with the present invention, the above object is attained by providing an inductance device having a bobbin having at least two chambers divided by a collar and a terminal embedded in the bobbin, wherein a coil is wound around the chambers and a ferrite core is mounted, in that the bobbin includes a chamber having a center hole for receiving the center leg of the core and two outer holes for each receiving the outer leg of the ferrite core in a bottom portion of the bobbin, and that a shield coil having a portion which is wound around the chamber via an upper collar of the bobbin is formed in a direction perpendicular to other bobbin chambers, a winding start and a winding end of the shield coil being connected to the bobbin terminal and being thereby short-circuited, or short-circuited to a substrate surface when the inductance device is mounted on a printed circuit board. In addition, since this shield coil has a possibility of coming into contact with a primary coil and a secondary coil wound around the other chambers in conjunction with the tendency toward a compact transformer, the shield coil can be formed with a safer structure by using a three-layered insulated wire for the purpose of satisfying the safety standards for transformers.

BRIEF DESCRIPTION OF THE DRAWINGS

A more complete appreciation of the invention and many of the attendant advantages thereof will be readily obtained as the same becomes better understood by reference to the following detailed descriptions when considered in connection with the accompanying drawings, wherein.

DETAILED DESCRIPTION OF THE PREFERRED EMBODIMENTS

Figure 1:
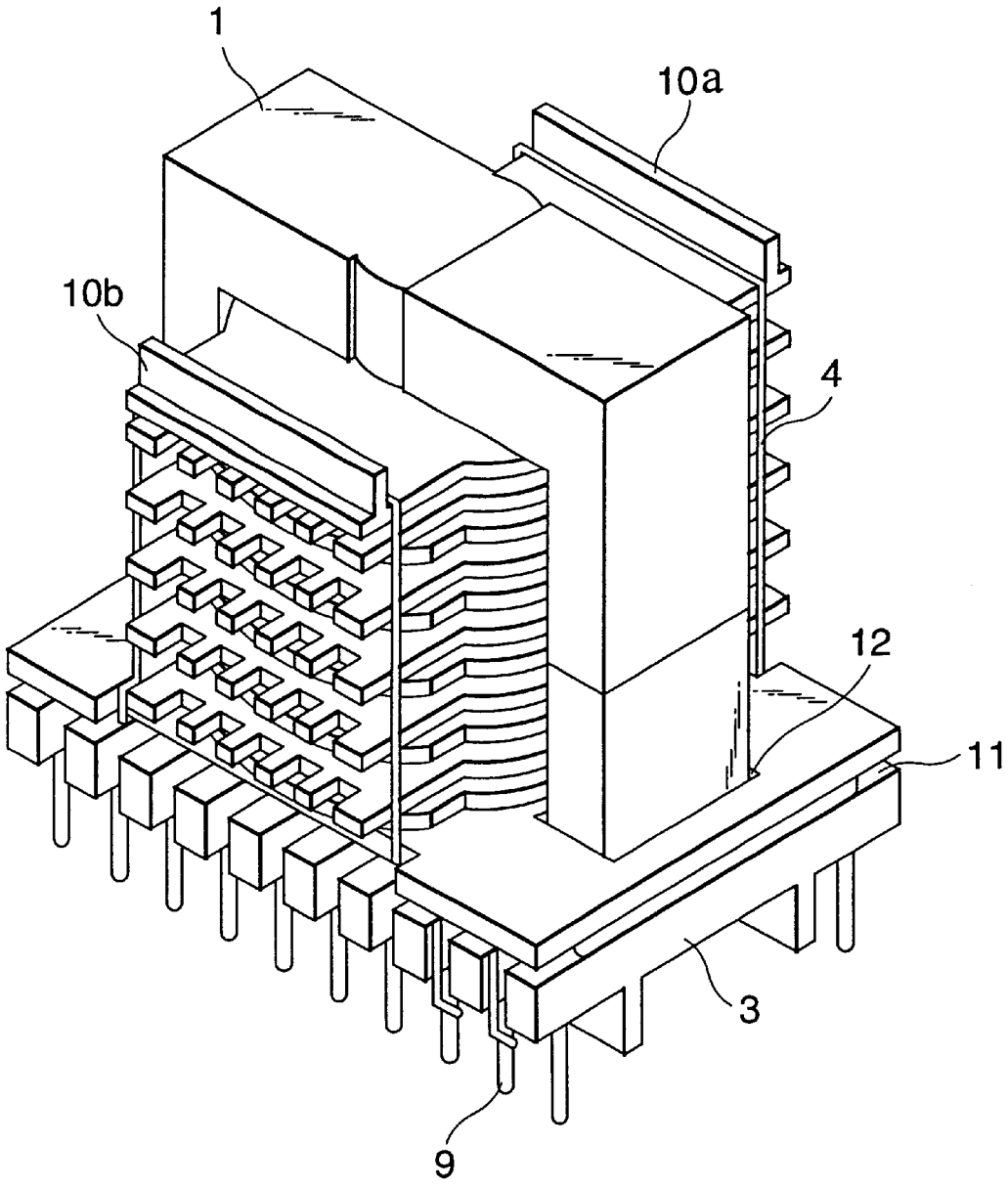
FIG. 1 is a perspective view of a first embodiment of a transformer in accordance with the present invention.

Referring now to the drawings, wherein like reference numerals designate identical or corresponding parts throughout the several views, and more particularly to FIGS. 1–5 thereof, there are illustrated exemplary embodiments of the present invention.

Figure 2:
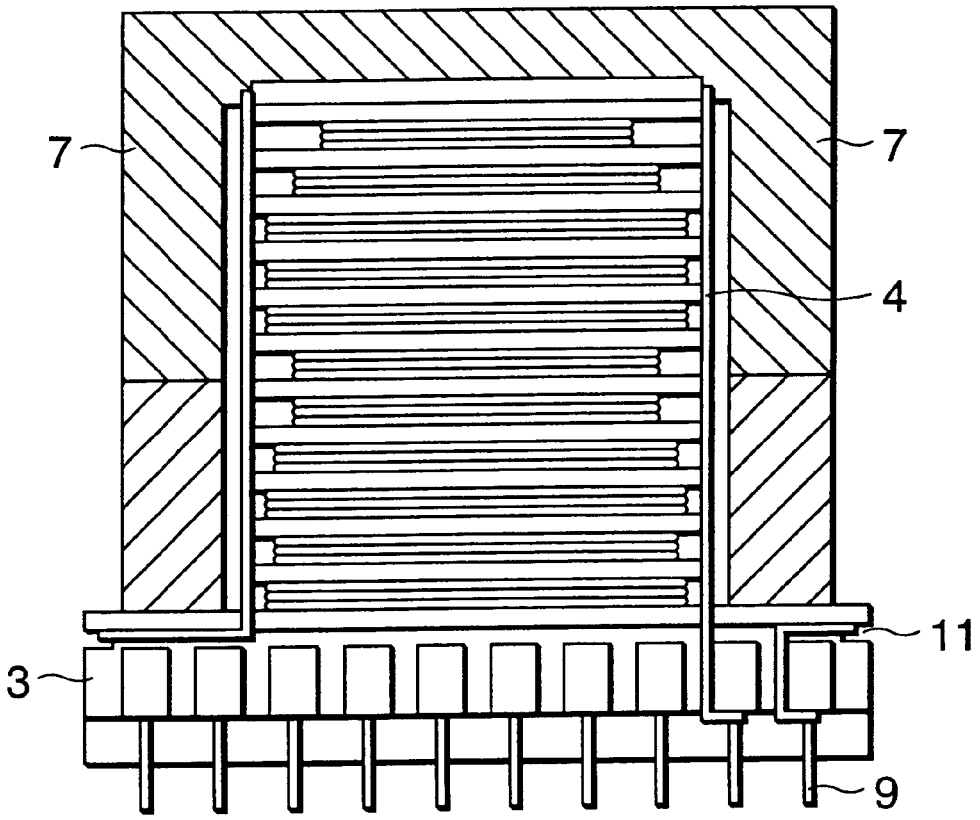
FIG. 2 is a front elevational view of the first embodiment.

FIG. 1 is a perspective view of the first embodiment of a transformer for a switching power supply, in which reference numeral 1 denotes a ferrite core, and numeral 3 denotes a bobbin. The bobbin is provided with a chamber 11 which has a center hole for inserting a center leg of the ferrite core and a pair of outer holes 12 for inserting a pair of core outer legs in a bottom portion of the bobbin. A shield coil 4 having a portion perpendicular to other bobbin chambers is wound around that chamber via bobbin upper collar projections 10*a* and 10*b*, and is connected to bobbin terminals 9. FIG. 2 is a front elevational view illustrating a portion in which the shield coil 4 is perpendicular to other coils, and both ends of the coil 4 are connected to the terminals 9 of the bobbin 3.

Figure 3:
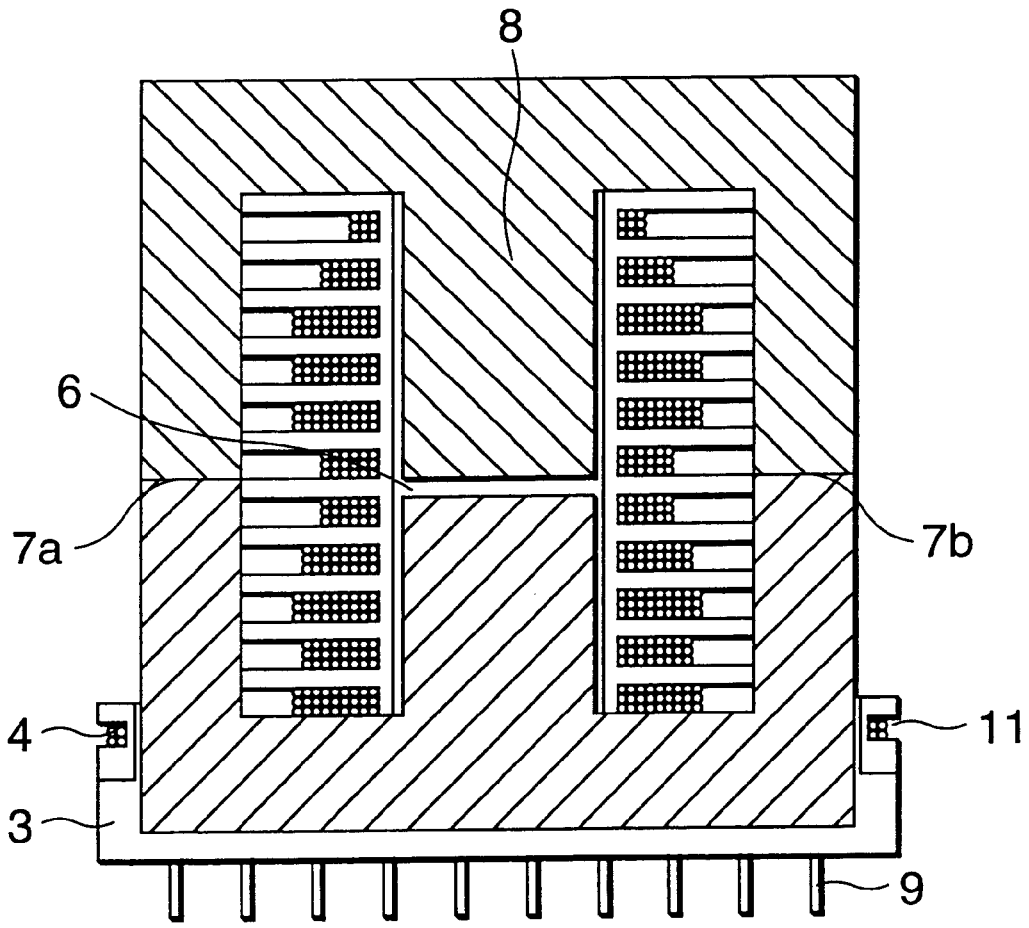
FIG. 3 is a cross-sectional view thereof.
Figure 4:
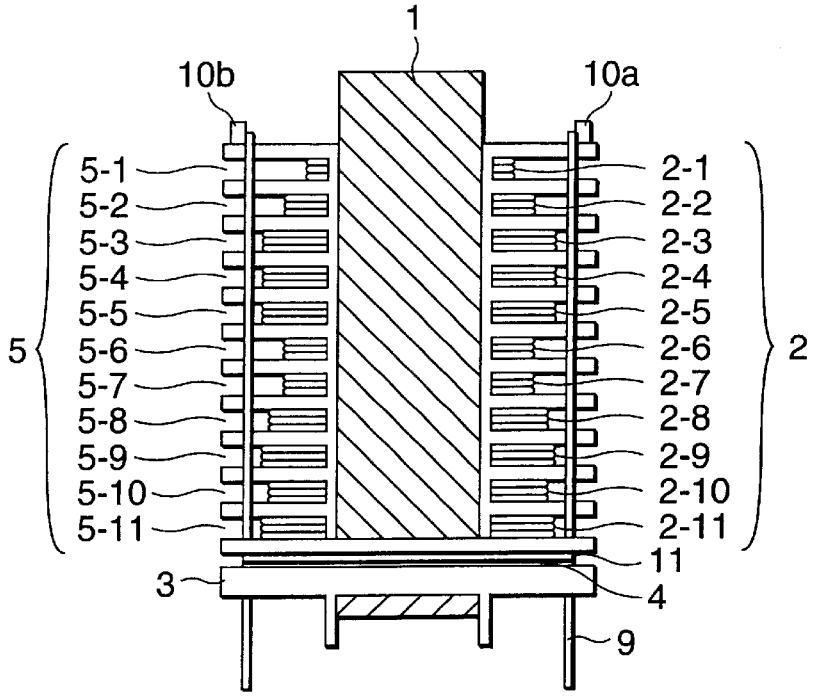
FIG. 4 is a side elevational view of the first embodiment.
Figure 5:
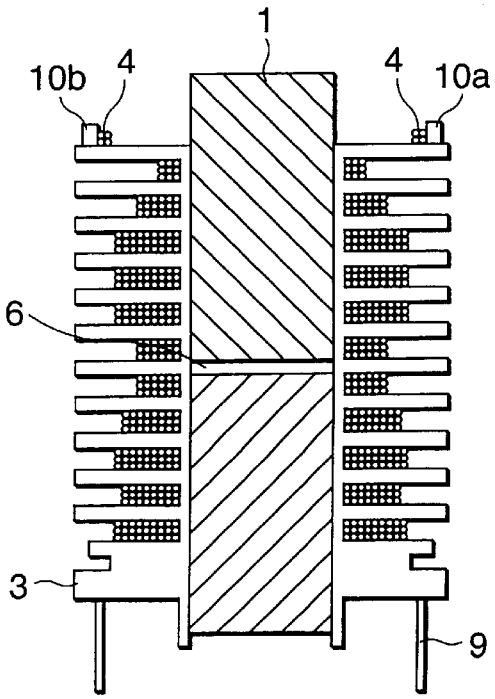
FIG. 5 is a cross-sectional view thereof.
Figure 6:
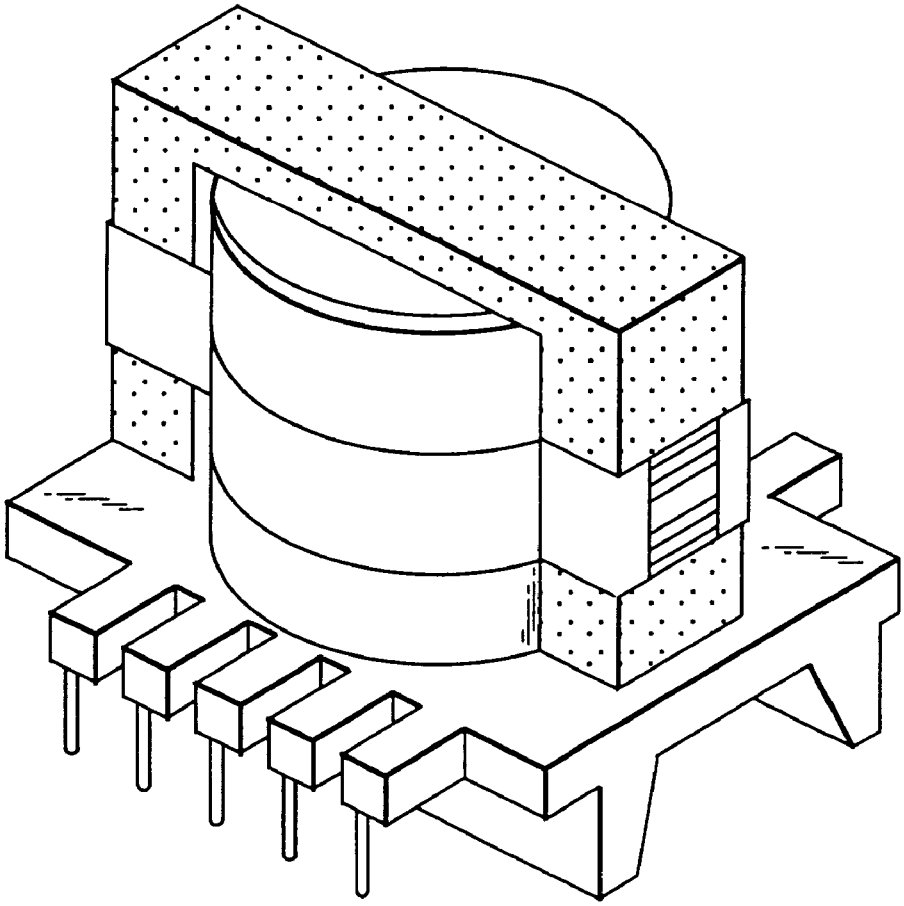
FIG.6 PRIOR ART
FIG. 6 is a conventional transformer with a copper plate shield ring.
Figure 7:
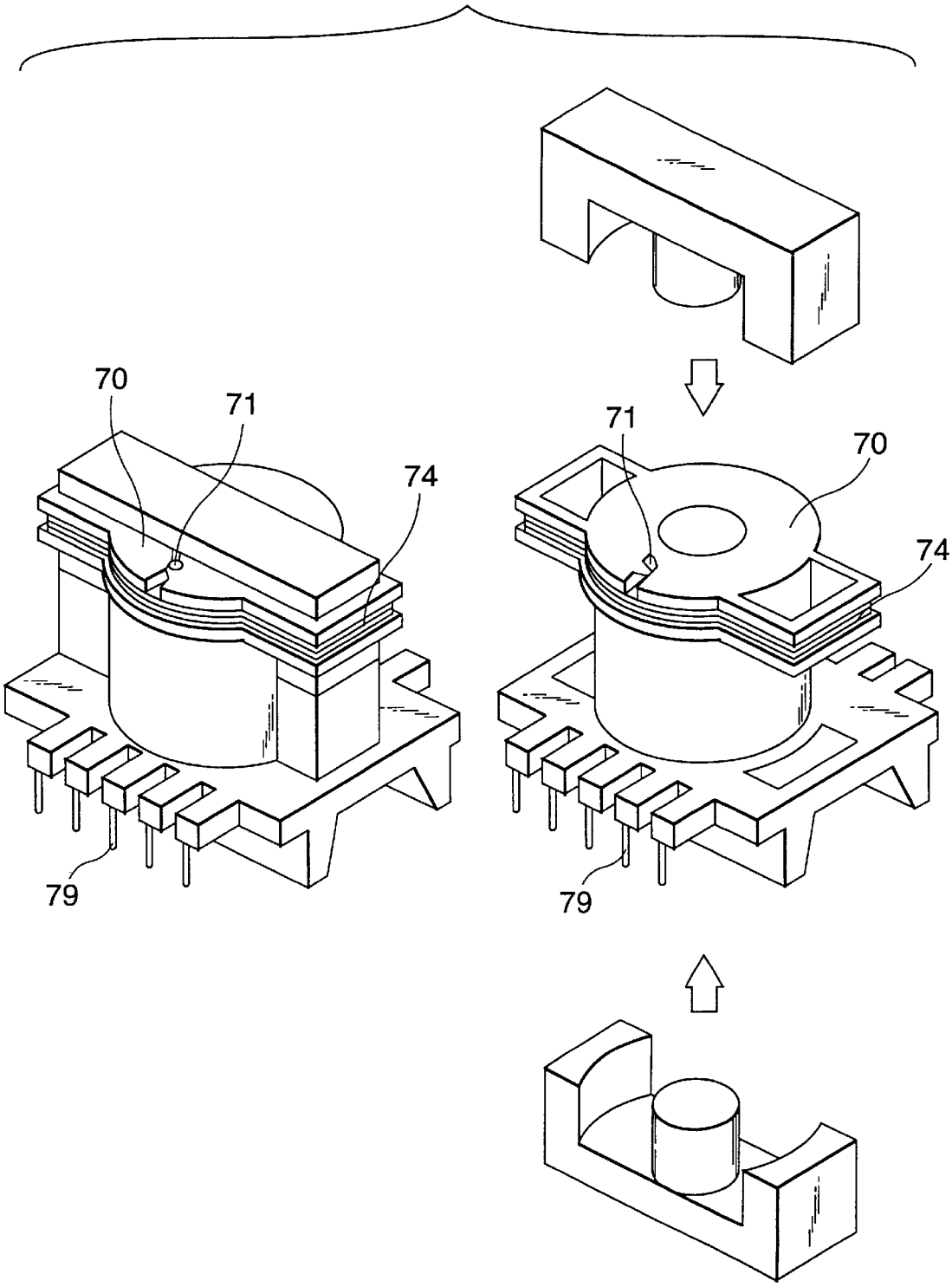
FIG.7 PRIOR ART
FIG. 7 is a diagram illustrating an example 1 of a conventional shielding method using a wire.
Figure 8:
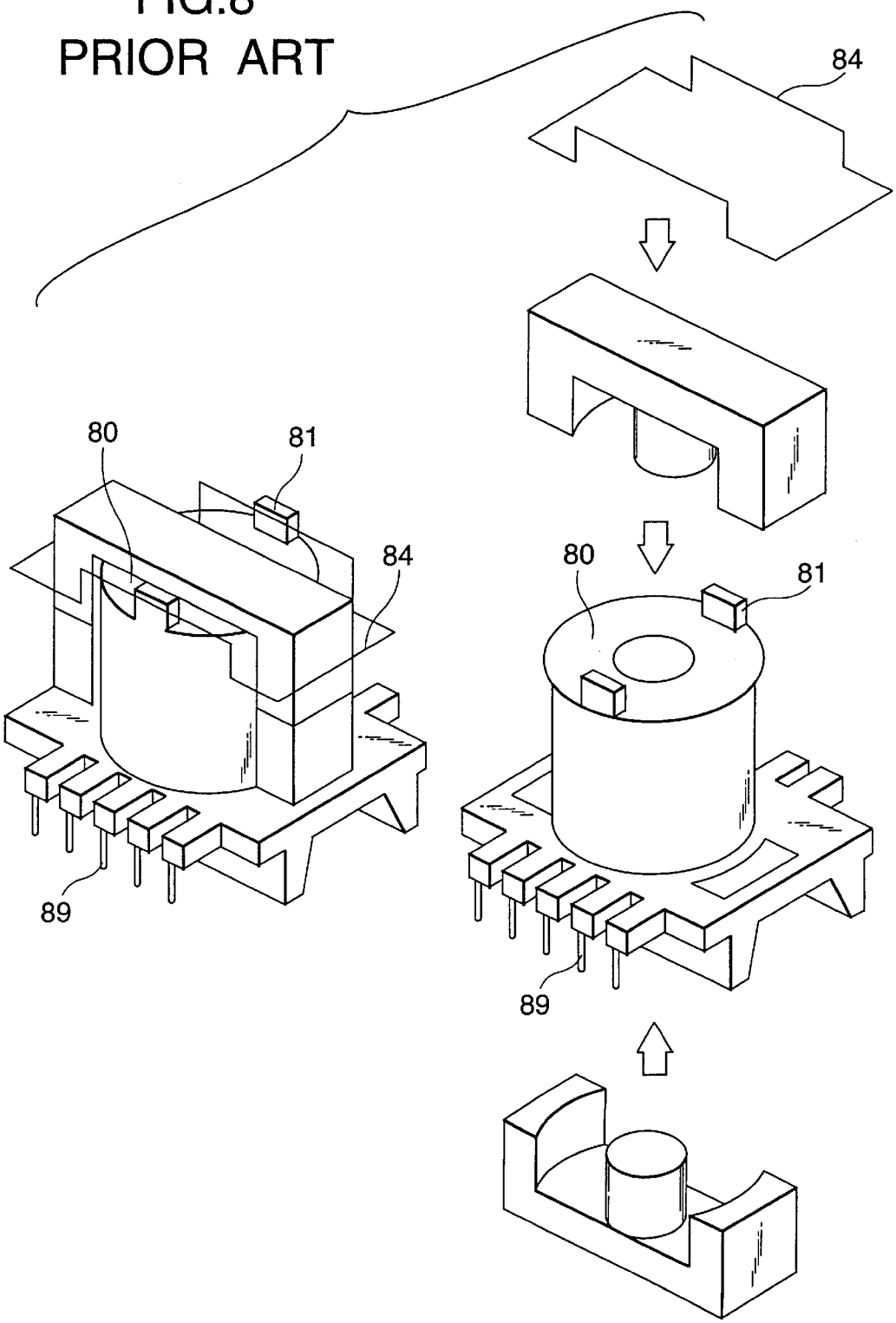
FIG.8 PRIOR ART
FIG. 8 is a diagram illustrating an example 2 of a conventional shielding method using a wire.
Figure 9:
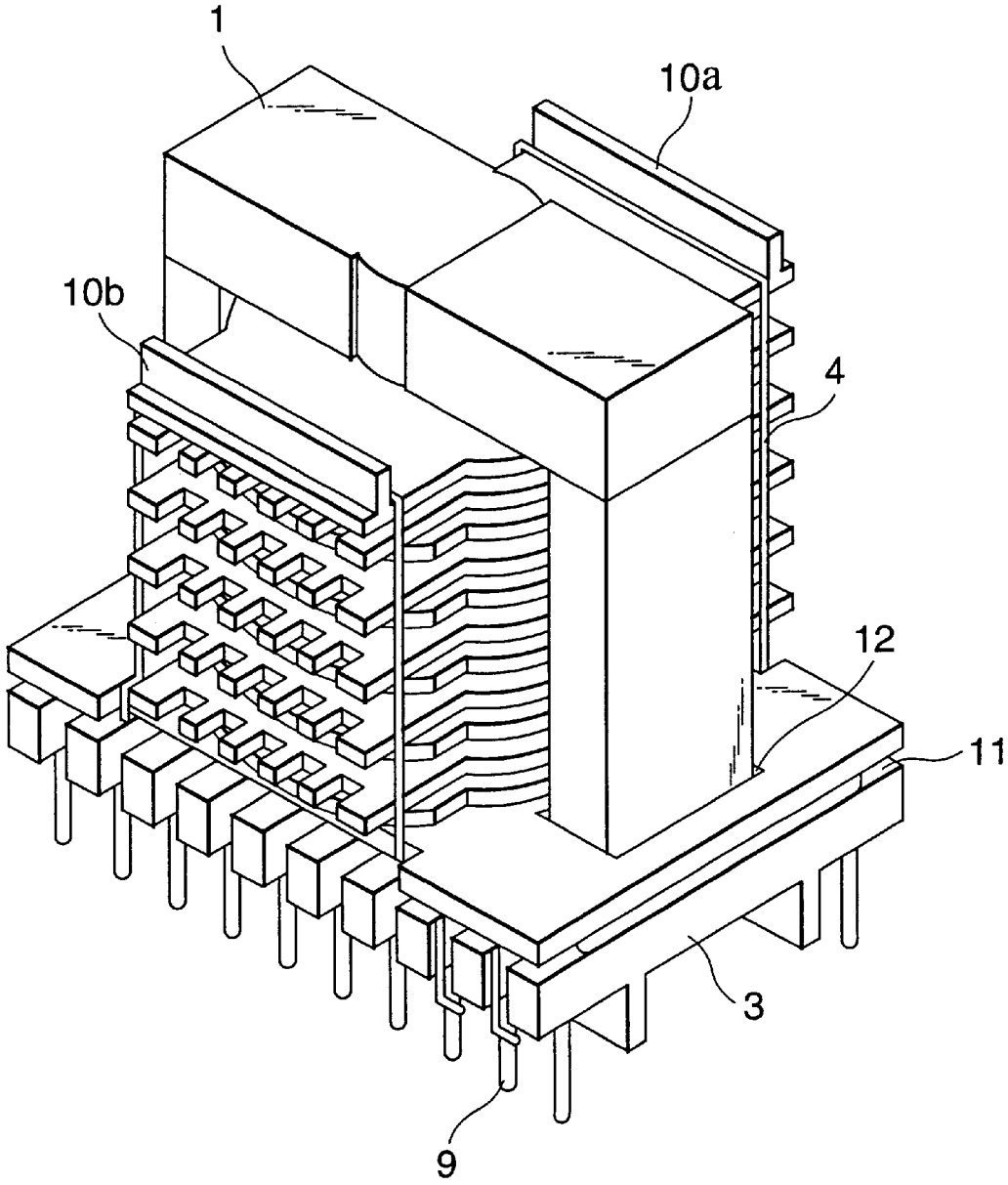
FIG. 9 is a perspective view of another embodiment of a transformer in accordance with the present invention, in that configuration of the ferrite core is different form that of FIG.

FIG. 3 is a cross-sectional view thereof. FIG. 4 is a side elevational view, and the bobbin 3 has collars at upper and lower ends thereof, and has a total of 11 chambers 5-1 to 5-11 which are sandwiched therebetween. Wound around these chambers are a primary auxiliary coil 2-1, a secondary coil 2-2, a primary main coil 2-3, a secondary coil 2-4, a primary main coil 2-5, a secondary coil 2-6, a secondary coil 2-7, a secondary coil 2-8, a primary main coil 2-9, a secondary coil 2-10, and a primary main coil 2-11. As for these coils, after winding is effected consecutively starting with the bobbin terminal-side chamber 5-11 up to the chamber 5-1, the shield coil 4 in accordance with the present invention is wound around in the shield-coil chamber 11 formed in the bottom portion of the bobbin 3, thereby forms portions perpendicular to a coil 2 via the bobbin upper collar projections 10*a* and 10*b*, and is led to the bobbin terminals 9. FIG. 5 is a cross-sectional view thereof. These coils are connected to the respective terminals in a single soldering step. Thus, since the shield coil 4 which constitutes a characteristic feature of the present invention makes it possible to complete the overall transformer in a series of process including that for the other coils of the transformer, there is an advantage in that the process of manufacturing the transformer is simplified as compared with the transformers of the conventional structure using a copper plate shield ring and the structure of the shield coil using a wire. In addition, since this shield coil may come into contact with a primary coil or a secondary coil wound around the other chambers in conjunction with the tendency toward a compact transformer, the shield coil can be formed with a safer structure by using a triple-layered insulated wire for the purpose of satisfying the safety standards for transformers. Regulation requires that even if any one layer in the triple-layered insulated wire suffers insulation-breakdown, the remaining two layer ensure the insulation of the wire.

Although a description has been given above by citing the transformer as an example, the present invention is also applicable to other usages in which a change in the magnetic flux is large other than the transformers, e.g., to inductors for active filters. Evaluation data on the shielding effect at a time when the shield coil 4 is fitted on the transformer is shown below.

Method of Evaluation

A comparison is made on the difference in the induced voltage in a case where the shield coil is provided and a case where it is not by using a search coil.

| | Shield Coil 4 Not Provided | Shield Coil 4 Provided |
|---|---|---|
| Induced voltage on the upper side of the transformer [mV] | 48 | 35 (reduced by approx. 27%) |
| Induced voltage on the core outer leg side [mV] | 42 | 23 (reduced by approx. 45%) |

Evaluation Data on the Shielding Effect Concerning the Shield Coil 4:

| | |
|---|---|
| Switching power supply output | 130 Watts |
| Circuit system | flyback system |
| Shape of the ferrite core | EER 40 |
| Dimension of the gap at the center leg of the core | 1.22 mm |
| Shield coil wire diameter | 0.35 mm |

Measurement Conditions:

From [KIK3] the foregoing results, it is possible to realize a transformer and an inductor for switching power supples which have the function of shielding leakage flux on both the upper side of the transformer and the overall side surfaces of the core outer legs.

By adopting the configuration of the present invention, it is possible to shield leakage flux over the upper side of the transformer and the overall side surfaces of the core outer legs, the present shield coil is subjected to winding in a series of winding process together with the other coils, and can be fabricated in a single soldering step. Accordingly, the conventional manual operation of attaching a shield ring using a copper plate or a wire can be dispensed with, so that the process of manufacturing the transformer and the inductor can be simplified. In addition, since the shield coil is integrated with the bobbin by means of the winding, the fixed state of the shield coil is made stable, and automation is also made possible.

What is claimed is:

1. An inductance device, comprising:

a ferrite core including a center leg and a pair of outer legs;

a bobbin, including, collar portions which define at least two chambers in said bobbin, a center hole for receiving the center leg of said ferrite core and two outer holes for each receiving an outer leg of said pair of outer legs of said ferrite core, said center and two outer holes located in a bottom portion of said bobbin, and collar projection portions located in a top portion of said bobbin;

a plurality of terminals embedded in said bobbin;

a primary coil wound around said chambers of said bobbin; and a shield coil having two ends and having a portion which is wound in a direction perpendicular to said primary coil between the collar projection portions of said bobbin, wherein one of said two ends of said shield coil is connected to one terminal of said plurality of terminals, another one of said two ends of said shield coil is connected to another terminal of said plurality of terminals, and said shield coil is formed of a triple-layered insulated wire.

2. The inductance device of claim 1, wherein said shield coil has a portion which is wound in a direction parallel to said primary coil.

* * * * *